US006540904B1

(12) United States Patent
Gun et al.

(10) Patent No.: US 6,540,904 B1
(45) Date of Patent: Apr. 1, 2003

(54) PROCESS FOR THE UPGRADATION OF PETROLEUM RESIDUE

(76) Inventors: Suhas Ranjan Gun, Central Fuel Research Institute P.O. F.R.I. -828 108, Dhanbad, Bihar (IN); Priya Bandhu Chowdhury, Central Fuel Research Institute P.O. F.R.I. -828 108, Dhanbad, Bihar (IN); Kashi Nath Bhattacharya, Central Fuel Research Institute P.O. F.R.I. -828 108, Dhanbad, Bihar (IN); Achinta Kumar Roy, Central Fuel Research Institute P.O. F.R.I. -828 108, Dhanbad, Bihar (IN); Umanand Sharma, Central Fuel Research Institute P.O. F.R.I. -828 108, Dhanbad, Bihar (IN); Swapan Kumar Ghosh, Central Fuel Research Institute P.O. F.R.I. -828 108, Dhanbad, Bihar (IN); Awadhesh Kumar Sinha, Central Fuel Research Institute P.O. F.R.I. -828 108, Dhanbad, Bihar (IN); Santosh Kumar Chanda, Central Fuel Research Institute P.O. F.R.I. -828 108, Dhanbad, Bihar (IN); Sukumar Mandal, Indian Oil Corporation Limited Research and Development Center, Sector 13, Faridabad, 121 007, Uttar Pradesh (IN); Sanjay Kumar Ray, Indian Oil Corporation Limited Research and Development Center, Sector 13, Faridabad - 121 007, Uttar Pradesh (IN); Asit Kumar Das, Indian Oil Corporation Limited Research and Development Center, Sector 13, Faridabad, -121 007, Uttar Pradesh (IN); Satish Makhija, Indian Oil Corporation Limited Research and Development Center, Sector 13, Faridabad, 121 007, Uttar Pradesh (IN); Sobhan Ghosh, Indian Oil Corporation Limited Research and Development Center, Sector 13, Faridabad, Uttar Pradesh (IN); Akhilesh Kumar Bhatnagar, Indian Oil Corporation Limited Research and Development Center, Sector 13, Faridabad, Uttar Pradesh (IN)

( * ) Notice: Subject to any disclaimer, the term of this patent is extended or adjusted under 35 U.S.C. 154(b) by 0 days.

(21) Appl. No.: 09/518,413

(22) Filed: Mar. 3, 2000

(51) Int. Cl.[7] ..... C10G 11/02

(52) U.S. Cl. ..... 208/113; 208/244; 208/253; 208/254 R; 208/295; 208/102

(58) Field of Search ..... 208/177, 113, 208/244, 253, 254 R, 295, 102

(56) References Cited

U.S. PATENT DOCUMENTS 4,001,385 A * 1/1977 Sanders ..... 208/216
4,588,477 A * 5/1986 Habib ..... 201/25
4,743,357 A * 5/1988 Patel et al. ..... 208/112

* cited by examiner

*Primary Examiner*—Walter D. Griffin
(74) *Attorney, Agent, or Firm*—Ladas & Parry

(57) ABSTRACT

The present invention provides a process for the upgradation of petroleum residue into useful fractions by subjecting petroleum residue in the presence of a solvent and ferrous sulphate catalyst to a pressure in the range of 10 atm. to 120 atm., temperature in the range of 380–420° C., for a period in the range of 0–120 minutes, in a reactor vessel, in an inert atmosphere. The charge is then cooled to room temperature and the product gas released through scrubbers. The residue is re-heated, if required, for free flow of liquid product. The resulting liquid product is distilled to obtain useful fractions.

7 Claims, No Drawings

PROCESS FOR THE UPGRADATION OF PETROLEUM RESIDUE

FIELD OF THE INVENTION

The present invention relates to a process for the upgradation of petroleum residue into useful fractions. More particularly, the present invention relates to. a process for the conversion of heavy residue (600° C.+) obtained after vacuum distillation of crude petroleum from petroleum refineries. End product from vacuum distillation generated in the petroleum refinery is used as a feed stock in the process of the present invention.

The present invention particularly relates to a process for the conversion of heavy petroleum residue in the presence of a homogeneous catalyst and solvent to a Total Cycle Oil (TCO 150°–370° C.) and specifically to Vacuum Gas Oil (VGO 370°–600° C.) range of products without using any external hydrogen.

This novel process for the conversion of heavy petroleum residue to a range of products covering up to Vacuum Gas Oil range under suitable operating conditions wherein hydrogen gain and high conversion are achieved with simultaneous suppression of the coke formation through hydrogen transfer from a non-conventional source and upgradation of the products of Total Cycle Oil and Vacuum Gas Oil range with improved qualities. The Vacuum Gas Oil range product will be used as a feed for Fluidised Catalytic Cracker Unit for existing refineries.

BACKGROUND OF THE INVENTION

U.S. Pat. No. 4,447,314 of 1984 describes a process for hydrotreating residual oil in an improved dual Bed Catalyst system comprising a first large pore catalyst and a second small pore catalyst in which at least second catalyst and preferably both catalysts have a quadrulobal shape catalysts used on cobalt and molybdenum on alumina.

European Patent No. EP 0202099 A3 of 1988 describes a process for treating heavy petroleum oil to produce high yield of useful oil products. The process comprises thermally cracking the heavy petroleum oil residues under conditions more severe than visbreaking but less severe than delayed coking while simultaneously subjecting said thermally cracking oil residues to steam stripping to separate and recover cracked gases and light oil vapours. The thermally cracked heavy fluid residue recovered from the thermal cracking step is then subjected to solvent extraction under temperature and pressure conditions in proximity of the critical point of the solvent to separate and recover heavy metal containing asphaltene containing fractions and low metal products therefrom.

U.S. Pat. No. 4,941,964 of 1990 describes a process where a hydrocarbon feed is hydrogenated by contacting it with hydrogen over a catalytic bed comprising (I) 3.0 to 5.0% wt Gr. VII metal oxide (preferably Ni or Co), (ii). 14.5 to 24.0 wt % of Gr. VIB metal oxide (preferably W or Mo), and (iii) 0–2.0 wt % of oxide of phosphorous on (iv) a porous alumina support. The present process is conducted in the presence of homogeneous catalyst in either solid state or in aqueous solution without using any external hydrogen gas.

While the above processes involve a single stage in the reaction, the yield of the product is very less.

EP 450997A of 1991 describes a at least two step hydrotreatment process for heavy hydrocarbon fractions. In step 1, hydrocarbon charge and hydrogen gas are passed over a fixed bed of hydrometallization catalyst. In step 2, the product from step 1 and hydrogen is passed over a hydrodesulphurisation catalyst.

U.S. Pat. No. 5,362,382 of 1994 describes a process for the hydrotreatment of heavy oil e.g. reside in two stages by contacting with hydrotreatment catalyst twice, the second time under more severe conditions at temperatures of 780–900° F., pressure 100–5000 psig and reaction time of 5 to 700 minutes. It is hydrotreated to obtain a product containing lighter hydrocarbon with lower metal content and the overall coking is significantly less.

U.S. Pat. No. 5,417,846 of 1995 describes a process hydrotreatment method in at least two stages—the first stage relating to hydrometallisation using hydrogen on hydrometallisation catalyst and the second stage relating to hydrodesulphurisation by passing the product of the first stage and hydrogen over a hydro—desulphurisation catalyst.

U.S. Pat. No. 5,417,846 a describes a process wherein a heavy hydrocarbon fraction containing asphaltenes, sulphur impurities and metallic impurities is hydrotreated by passing the charge and hydrogen over a hydrometallisation catalyst and then over a hydrosulphurisation catalyst.

French Patent FR 2718147 A describes a hydrotreatment process in three stages wherein in the first stage, oil cut is contacted with a hydrotreatment catalyst in the presence of hydrogen. The product is then contacted with a hydrocracking catalyst in the second stage. The product of the second stage is fractionated to separate into light constituents and the residue is contacted with a hydroisomerisation catalyst in the presence of hydrogen.

French Patent FR 2718146 A describes a process for the production of oil with a viscosity index between 95 to 150 from heavy petroleum cuts by a two-stage process. The cut is first contacted with a hydrotreatment catalyst containing a Gr. VI and Gr. VIII element on an amorphous support in the presence of hydrogen. In the second stage at least part of the effluent from stage one is contacted with hydroisomerisation catalyst in presence of hydrogen.

In all the above cases, the hydrotreatment processes are applied in two or three stages.

OBJECTS OF THE INVENTION

It is the main object of the invention to provide a process for the upgradation of petroleum residue into useful fractions, which obviates the drawbacks detailed above.

It is another object of the invention to provide a process for conversion of petroleum heavy residue to lighter products such as Total Cycle oil and Vacuum Gas Oil without using any external hydrogen in which water and light aromatic hydrocarbons such as benzene and toluene are used as solvents.

It is a further object of the invention to provide a process for the conversion of petroleum heavy residue in which there is overall distinct hydrogen gain compared to original feed stock used without supplying external hydrogen.

It is another object of the invention to develop a process for the conversion of petroleum. heavy residue to lighter products having a yield of 50 to 70% without any coke formation with improved product quality including substantially lower amount of sulphur compared to conventional visbreaking process.

SUMMARY OF THE INVENTION

Accordingly, the present invention provides a process for the upgradation of petroleum residue into useful fractions, said process comprising subjecting petroleum residue in the presence of a solvent and ferrous sulphate catalyst in a reactor vessel, to a pressure in the range of 10 atm. to 120 atm., temperature in the range of 380–420° C., for a period in the range of 0–120 minutes, in an inert atmosphere, cooling to room temperature, releasing the product gas through scrubbers, re-heating the residue, if required, for free flow of liquid product, distilling the resultant liquid product by conventional methods to obtain useful fractions.

In one embodiment of the invention, the heavy residue, the catalyst and the solvent are made to react in an autoclave having provision temperature and pressure recording.

In a further embodiment of the invention, the process is done as a single step process without using hydrogen gas.

In another embodiment of the present invention, the feed stock comprises heavy residue obtained from petroleum refinery after distilling out of the lighter products under vacuum. At STP the feed looks like a solid mass which softens with the rise in temperature.

In another embodiment of the invention, the catalyst used is acidified to maintain a pH in the range of 4.0 to 5.0.

In another embodiment of the present invention, water or lighter aromatics like benzene or toluene are used as solvent.

In a further embodiment of the invention, the feed to solvent ratio is 2:1.

DETAILED DESCRIPTION OF THE INVENTION

The present process for the upgradation of heavy petroleum residue is done in a single stage without using hydrogen gas. The catalyst used in the present process is ferrous sulphate ($FeSO_4.7H_2O$) in either solid state or in an aqueous solution in the range of 0–10 wt %.

Water is a protic solvent and hydrocarbons like aromatics, aliphatics and naphthenes have different degrees of solubility in water. In super critical condition, solubility of organic compounds increases in the order of aromatics<naphthenes<aliphatics. Under such conditions, water provides a means of physical separation of different classes of hydrocarbons. In the vapour phase, hydrogen enriched fractions are concentrated and in the liquid phase, hydrogen deficient hydrocarbons are enriched. Thus in the water phase, hydrogen shuttling reactions occur from liquid to gas phase. As a protic solvent, water interacts with the hydrocarbons and splits the products and becomes efficient dealkylating agent. The sequence of the reactions that occur are as follows:

thermal cleaving of residue into free radicals capping of radicals through hydrogen abstraction transfer of the lower boiling products into the vapour phase followed by proton transfer from the solvent.

The process of the present invention results in the conversion of petroleum residue to lighter products up to VGO range (370–600° C.) with a yield of 50–70% and without any coke formation. The lighter products are found to possess improved product qualities including substantially lower amount of sulphur compared to the visbreaking process. The process of the present invention also results in substantial hydrogen gain compared to the original feed stock used without supplying any external hydrogen gas.

The following examples are given by way of illustration only and should not be construed as limiting the scope of the present invention.

EXAMPLE 1

This example describes the treatment of heavy residue in the presence of water and catalyst as per the process of this invention.

| Boiling composition | |
|---|---|
| 590° C.– | 20.5 |
| 590° C.+ | 79.5 |
| **Physical properties** | |
| API Gravity | 9.86 |
| Pour Point° C. | 70.00 |
| CCR % w/w | 16.40 |
| **Elemental Analysis** | |
| Carbon | 86.05 |
| Hydrogen | 11.35 |
| Sulphur | 0.26 |
| Total Nitrogen | 0.55 |
| **Hydrocarbon class distribution** | |
| Aromatics | 44.70 |
| Naphthenes | 17.10 |
| Paraffins | 38.20 |
| Olefins | 0.00 |

Feed as such in normal condition of 27° C. is a solid mass. 400 g of the above feed (North Gujarat vacuum residue, obtained from Gujarat Refinery, Indian Oil Corporation, Vadodara, India), 200 g water and 4.0 g ferrous sulphate (hydrated) was taken having physico chemical properties as given below. Ferrous sulphate catalyst was dissolved in 50 cc distilled water. 10 drops of concentrated sulphuric acid was added to the solution and the feed was poured in shaking type autoclave of 4 litre capacity. Remaining water after dissolving the catalyst was poured into the vessel. Shaking angle of the autoclave was about 30° above and below the horizontal position. The pressure vessel was then sealed and flushed with nitrogen to eliminate air within the vessel. Any leakage of the autoclave was thoroughly checked by raising the pressure up to 10 atmospheres. The pressure was then released and the whole charge (feed+water+catalyst solution) was kept in inert atmosphere. Shaking and heating of the autoclave was then started. Since the vessel was electrically heated, it required about 120 minutes to attain the test temperature of 420° C. The temperature was maintained at 420° C. by adjusting the voltage. After the reaction temperature was attained (0 minute), the reactor was allowed to cool by providing cooling arrangement. Within 70 minutes the temperature came down below 250° C. Natural cooling was followed for the autoclave to attain room temperature. The product gas was released by passing through scrubbers containing N/10 sulphuric acid solution to absorb any ammonia gas produced and two scrubbers containing 10% cadmium chloride solution to arrest $H_2S$ gas produced as cadmium sulphide and the total product gas was collected through water gas meter at room temperature and pressure. After gas collection, the vessel was heated to 50° C. to collect the liquid product material easily. Then the vessel was opened. Total liquid product was collected in a pre-weighed distillation flask (A). The inside part of the autoclave and the lid was washed with toluene. The total washing was collected in a separate vessel. After removing the solvent the liquid product was again weighed (B). The total liquid product was (A)+(B).

The total liquid product was then distilled at normal pressure to get gasoline fraction (up to 150° C.) along with water which was separated in separating funnel. Thus, gas water, gasoline and above 150° C. product were obtained. The fraction 150° C.+ was then distilled under vacuum at 2 mm Hg pressure to get 150° C. to 370° C. and above 370° C. fractions. A part of the 150° C.+ fraction was distilled by standard method to get 150–370° C., 370–580° C. and 580° C.+ fractions. Typical experimentation conditions, percentage yield of different fractions, and the product characterisation are shown in Table 1.

TABLE 1

| Experimental conditions | |
|---|---|
| Temperature | 420° C. |
| Catalyst concentration | 1% |
| Purged gas | Nitrogen |
| Initial hot pressure | 120 kg/cm$^2$ |
| Final hot pressure | 120 kg/cm$^2$ |

Reaction time: Reactor was heated from 30° C. to 420° C. at constant heating rate and immediately cooled down. No retention time was provided after the temperature reached the target reactor temperature value.

| Product distribution | | wt % | |
|---|---|---|---|
| Hydrogen gas | | 0.01 | |
| Other gases | | 2.1 | |
| $C_5$–150° C. | | 9.9 | |
| 150–370° C. | | 9.0 | |
| 370–580° C. | | 28.7 | |
| >580° C. | | 50.3 | |
| Conversion up to 600° C. | | 56.7 | |
| % of feed sulphur converted to $H_2S$ | | 32% | |
| Elemental distribution | 150–370° C. | 370–580° C. | >580° C. |
| Carbon | 85.90 | 86.50 | 88.42 |
| Hydrogen | 12.40 | 11.85 | 9.95 |
| Others | 1.80 | 1.65 | 1.63 |
| Hydrocarbon class distribution | 150–370° C. | 370–580° C. | >580° C. |
| Aromatics | 26.7 | 43.6 | 49.1 |
| Naphthenes | 16.6 | 20.6 | 24.8 |
| Paraffins | 51.6 | 32.8 | 23.1 |
| Olefins | 5.0 | 3.0 | 3.0 |
| Physical properties | | 150–370° C. | |
| API Gravity | | 29.30 | |
| Aniline point° C. | | 72.00 | |
| Pour point° C. | | 8.60 | |
| CCR % w/w | | 0.05 | |

Maximum retention time allowable at 420° C. without coke formation = 60 min.

TABLE 1A

Typical Hydrogen gain in solvent stripped catalytic visbreaking

| No. | 1 | 2 | 3 | 4 |
|---|---|---|---|---|
| Feed charge (gms) | 400 | 400 | 400 | 400 |
| Catalyst on feed (%) | 1 | 5 | 10 | 1 |
| Solvent charged (gms) | 200 | 200 | 200 | 200 |
| Temp. (° C.) | 400 | 400 | 380 | 420 |
| Retention time at reaction temp. (minutes) | 120 | 120 | 120 | 0 |
| Hydrogen content in feed Wt % | 11.9 | 11.9 | 11.9 | 11.9 |
| Hydrogen on product Wt % | 12.14 | 12.05 | 12.69 | 11.98 |
| Hydrogen gain | 0.24 | 0.25 | 0.79 | 0.08 |

EXAMPLE 2

This example describes the processing of the heavy residue feed in presence of catalyst only. The amount of heavy residue and the catalyst are same as in Example 1. No water is added to the system. Hydrated ferrous sulphate is added as the solid catalyst. The experimental conditions, method of product gas and liquid collection are maintained almost identical as in Example 1. The experimental conditions, product yield patterns and their characterisation are shown in Table 2.

TABLE 2

| Experimental conditions of Example 2: | | | |
|---|---|---|---|
| Temperature | | 420° C. | |
| Catalyst concentration | | 1% | |
| Purged gas | | nitrogen | |
| Product distribution | | | |
| Hydrogen gas | | 0.0 | |
| Other gases | | 2.2 | |
| $C_5$–150° C. | | 2.2 | |
| 150–370° C. | | 9.5 | |
| 370–590° C. | | 28.0 | |
| >590° C. | | 58.1 | |
| Conversion upto 600° C. | | 45.5 | |
| % of feed sulphur converted to $H_2S$ | | 3.4% | |
| Elemental distribution | 150–370° C. | 370–590° C. | >590° C. |
| Carbon | 84.90 | 87.10 | 86.97 |
| Hydrogen | 12.40 | 12.01 | 9.92 |
| Others | 2.70 | 0.89 | 3.11 |
| Hydrocarbon class distribution | 150–370° C. | 370–590° C. | >590° C. |
| Aromatics | 27.9 | 42.4 | 45.3 |
| Naphthenes | 20.1 | 18.1 | 21.0 |
| Paraffins | 47.0 | 36.5 | 30.7 |
| Olefins | 5.0 | 3.0 | 3.0 |
| Physical properties | | 150–370° C. | |
| API Gravity | | 29.30 | |
| Aniline point° C. | | 65.00 | |
| Pour point° C. | | 12.00 | |
| CCR % w/w | | 0.02 | |

Maximum retention time allowable at 420° C. without coke formation = 20 min.

EXAMPLE 3

This example describes the processing of heavy residue feed without catalyst or water.

The feed material in this example is only heavy residue. The amount of heavy residue is same as in Example 1. Experimental conditions, methods of product gas and liquid collection are maintained same as in Example 1. The experimental conditions, product yield pattern and their characterisation are shown in Table 3.

TABLE 3

| Experimental conditions: | | | |
|---|---|---|---|
| Temperature | | 420° C. | |
| Purged gas | | nitrogen | |
| Product distribution | | | |
| Hydrogen gas | | 0.0 | |
| Other gases | | 2.12 | |
| $C_5$–150° C. | | 2.1 | |
| 150–370° C. | | 11.2 | |
| 370–590° C. | | 27.3 | |
| >590° C. | | 57.2 | |
| Conversion up to 600° C. | | 46.3 | |
| % of feed sulphur converted to $H_2S$ | | 2.3 % | |
| Elemental distribution | 150–370° C. | 370–590° C. | >590° C |
| Carbon | 84.37 | 86.23 | 86.61 |
| Hydrogen | 12.23 | 11.87 | 9.82 |
| Others | 3.40 | 1.90 | 3.57 |
| Hydrocarbon class distribution | 150–370° C. | 370–590° C. | >590° C. |

TABLE 3-continued

| | | | |
|---|---|---|---|
| Aromatics | 28.6 | 46.4 | 47.7 |
| Naphthenes | 18.4 | 23.7 | 24.8 |
| Paraffins | 48.0 | 27.0 | 27.3 |
| Olefins | 5.0 | 3.0 | 3.0 |
| Physical properties | | 150–370° C. | |
| API Gravity | | 31.14 | |
| Aniline point° C. | | 68.00 | |
| Pour point° C. | | 5.00 | |
| CCR % w/w | | 0.06 | |

Maximum retention time allowable at 420° C. without coke formation = 0 min.

We claim:

1. A process for the upgradation of petroleum residue into lighter products, said process comprising subjecting petroleum residue in the presence of a solvent and ferrous sulphate catalyst in a reactor vessel to a pressure in the range of 10 atm. to 120 atm., temperature in the range of 380–420° C., for a period in the range of 1–120 minutes in an inert atmosphere, cooling to room temperature, releasing the product gas through scrubbers, re-heating the residue, if required, for free flow of liquid product, and distilling the resultant liquid product to obtain the lighter products.

2. A process as claimed in claim 1 wherein petroleum residue comprises heavy residue obtained from a petroleum refinery after distillation out of the lighter products under vacuum.

3. A process as claimed in claim 1 wherein the solvent used is selected from water, benzene or toluene.

4. A process as claimed in claim 1 wherein the reactor vessel used is an autoclave.

5. A process as claimed in claim 1 wherein the inert atmosphere is maintained using nitrogen gas.

6. A process as claimed in claim 1 wherein the catalyst used is acidified to maintain a pH in the range of 4.0 to 5.0.

7. A process as claimed in claim 1 wherein the petroleum residue to solvent ratio is 2:1 (mass/mass).

* * * * *